US007753129B2

(12) United States Patent
Head

(10) Patent No.: US 7,753,129 B2
(45) Date of Patent: Jul. 13, 2010

(54) WIRELINE OR COILED TUBING DEPLOYED ELECTRIC SUBMERSIBLE PUMP

(75) Inventor: Philip Head, West Drayton (GB)

(73) Assignee: Artificial Lift Company Limited, Great Yarmouth (GB)

( * ) Notice: Subject to any disclaimer, the term of this patent is extended or adjusted under 35 U.S.C. 154(b) by 223 days.

(21) Appl. No.: 12/009,607

(22) Filed: Jan. 18, 2008

(65) Prior Publication Data

US 2008/0196902 A1 Aug. 21, 2008

(30) Foreign Application Priority Data

Jan. 19, 2007 (GB) ..... 0701061.4

(51) Int. Cl.
*E21B 43/00* (2006.01)
*E21B 33/12* (2006.01)

(52) U.S. Cl. ..... 166/385; 166/106; 166/187; 166/387

(58) Field of Classification Search ..... 166/106, 166/187, 387, 105
See application file for complete search history.

(56) References Cited

U.S. PATENT DOCUMENTS 5,109,925 A * 5/1992 Stepp et al. ..... 166/184

FOREIGN PATENT DOCUMENTS

WO WO-2008032126 3/2008

* cited by examiner

*Primary Examiner*—David J Bagnell
*Assistant Examiner*—Catherine Loikith
(74) *Attorney, Agent, or Firm*—Andrew Wilford

(57) ABSTRACT

An electric submersible pump and motor assembly for downhole applications has an electric motor having a stationary nonrotating through bore, a pump driven by the electric motor, a deployment line upon which the electric motor and pump may be lowered down through a production tube, and a seal for sealing the assembly against the production tube. An inlet upstream of the seal through which well bore fluid may flow extends through the pump and the stationary nonrotating through bore of the motor, and the fluid may exit through an outlet open to the well bore downstream of the seal.

16 Claims, 4 Drawing Sheets

WIRELINE OR COILED TUBING DEPLOYED ELECTRIC SUBMERSIBLE PUMP

FIELD OF THE INVENTION

This invention relates to electric submersible pumps that can be deployed on a wireline or length of coiled tubing.

BACKGROUND OF THE INVENTION

Electrical submersible pumps are commonly used in oil and gas wells for producing large volumes of well fluid. An electrical submersible pump (hereinafter referred to "ESP") normally has a centrifugal pump with a large number of stages of impellers and diffusers. The pump is driven by a downhole motor, which is a large three-phase motor. A seal section separates the motor from the pump to equalize the internal pressure of lubricant within the motor to the pressure of the well bore. Often, additional components will be included, such as a gas separator, a sand separator and a pressure and temperature measuring module.

An ESP is normally installed by securing it to a string of production tubing and lowering the ESP assembly into the well. Production tubing is made up of sections of pipe, each being about 30 feet in length. The well will be 'dead', that is not be capable of flowing under its own pressure, while the pump and tubing are lowered into the well. To prevent the possibility of a blowout, a kill fluid may be loaded in the well, the kill fluid having a weight that provides a hydrostatic pressure significantly greater than that of the formation pressure. During operation, the pump draws from well fluid in the casing and discharges it up through the production tubing. While kill fluid provides safety, it can damage the formation by encroaching into the formation. Sometimes it is difficult to achieve desired flow from the earth formation after kill fluid has been employed. The kill fluid adds expense to a workover and must be disposed of afterward. ESP's have to be retrieved periodically, generally around every 18 months, to repair or replace the components of the ESP. It would be advantageous to avoid using a kill fluid. However, in wells that are 'live', that is, wells that contain enough pressure to flow or potentially have pressure at the surface, there is no satisfactory way to retrieve an ESP and reinstall an ESP on conventional production tubing.

Coiled tubing has been used for a number of years for deploying various tools in wells, including wells that are live. A pressure controller, often referred to as a stripper and blowout preventer, is mounted at the upper end of the well to seal around the coiled tubing while the coiled tubing is moving into or out of the well. The coiled tubing comprises steel tubing that wraps around a large reel. An injector grips the coiled tubing and forces it from the reel into the well. The preferred type of coiled tubing for an ESP has a power cable inserted through the bore of the coiled tubing. Various systems are employed to support the power cable to the coiled tubing to avoid the power cable parting from the coiled tubing under its own weight. Some systems utilize anchors that engage the coiled tubing and are spaced along the length of the coiled tubing. Another uses a liquid to provide buoyancy to the cable within the coiled tubing. In the coiled tubing deployed systems, the pump discharges into a liner or in casing. A packer separates the intake of the pump from the discharge into the casings. Although there are some patents and technical literature dealing with deploying ESP's on coiled tubing, only a few installations have been done to date, and to date they have only been installed inside large casings, where the oil can flow around the outside of the motor and the pump intake is on the housing diameter.

In addition wireline has also been used to deploy ESP's, both these means are very cost effective and have a dramatic impact on the cost of deploying an ESP into a well.

OBJECTS OF THE INVENTION

It is an object of this invention to be able to provide an electric submersible pump that can conveniently be lowered on a wireline or coiled tubing.

Another object is to be able to provide an ESP that may be used without killing the well it is to be deployed in.

SUMMARY OF THE INVENTION

According to the invention there is provided an electric submersible pump and motor assembly for downhole applications, comprising an electric motor, a pump driven by the electric motor, a deployment line upon which the electric motor and pump may be lowered down through a production tube, and a sealing means for sealing the assembly against the production tube, the motor having a stationary non-rotating through bore, the assembly having an inlet upstream of the sealing means through which well bore fluid may flow, which leads through the pump and the stationary non-rotating through bore of the motor, and an outlet open to the well bore downstream of the sealing means through which the well bore fluid may exit.

According to another aspect of the invention there is provided a submersible pump and motor assembly for downhole applications, comprising a motor, a pump driven by the motor, and an inflatable packer for sealing the assembly against the production tube. The fluid from the pump is constrained by a burst disc to enter the inflatable packer through a one-way valve, such that the burst disc breaks to allow the pumped well fluid access to the outlet when the inflatable packer has been fully inflated.

Such an assembly can be manufactured with a small diameter, making the assembly especially suitable for relatively small-bore applications.

BRIEF DESCRIPTION OF THE DRAWINGS

The following FIGS. will be used to describe embodiments of the invention which are given as examples and not intended to be limiting.

DESCRIPTION OF THE PREFERRED EMBODIMENT

Figure 1:
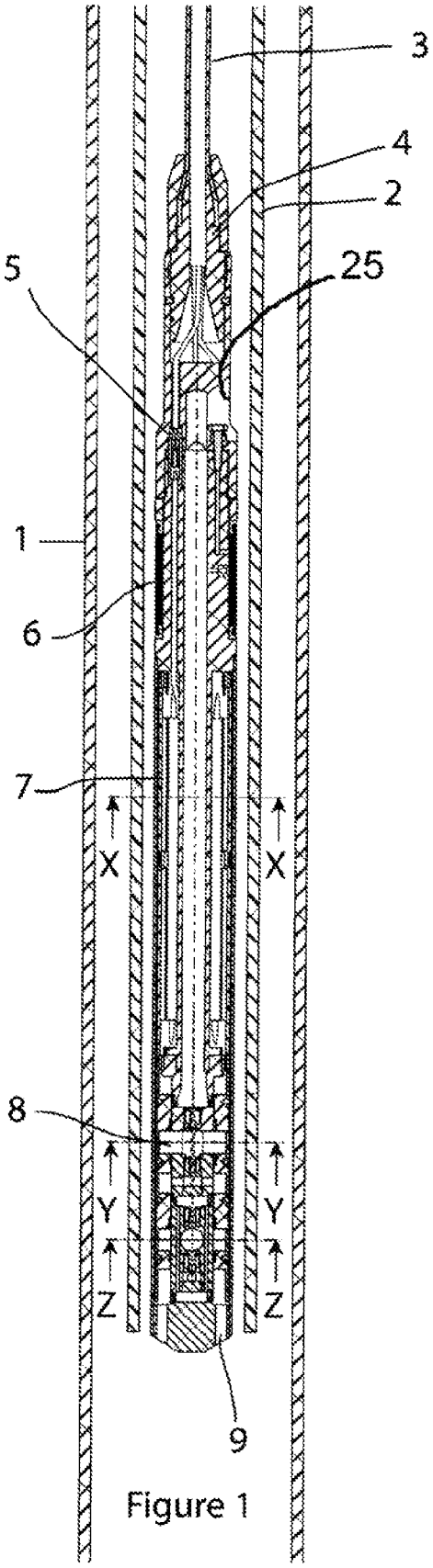
FIG. 1 is a side view of the through tubing ESP in situ in the lowermost part of a production tubing tailpipe.
Figure 2:
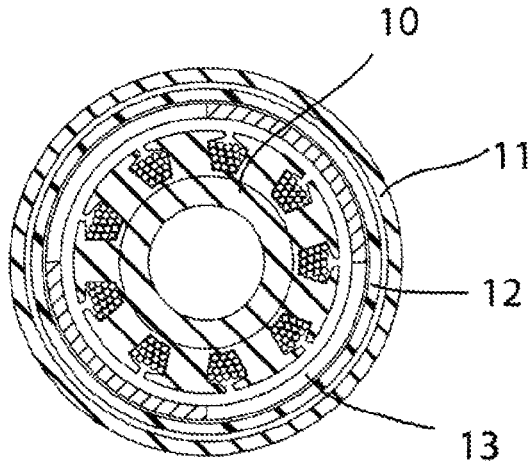
FIG. 2 is an end view cross section XX of FIG. 1
Figure 3:
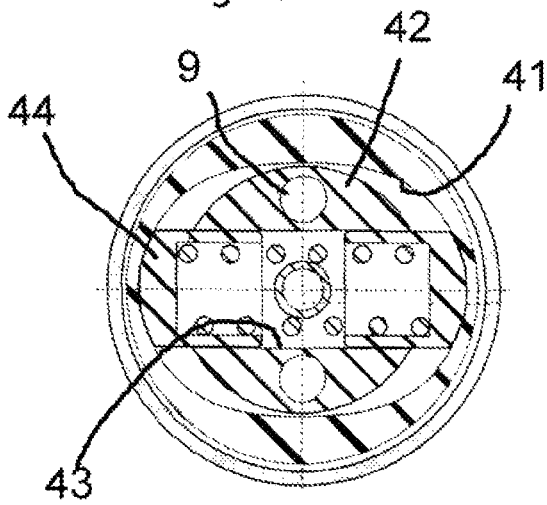
FIG. 3 is an end view cross section ZZ of FIG. 1

Referring to FIGS. 1 to 7 there is shown a well casing 1 with production tubing 2 disposed inside the well casing. The electrical submersible pump consists of a braided wireline 3 secured to the ESP in a rope socket 4, the electrical conductors terminating 5 at an electric motor assembly 7, an inflatable packer 6, a pump 8 attached to and driven by the electric motor assembly 7, the pump having a pump inlet 9. A chamber 14 leads from the pump through the center of the motor, exiting through assembly outlet 25. Referring particularly to FIG. 2, the motor has a center 10 that remains stationary during operation, an outside housing 11 which similarly remains stationary, and a rotating part 12 on which magnets 13 are mounted.

Figure 5:
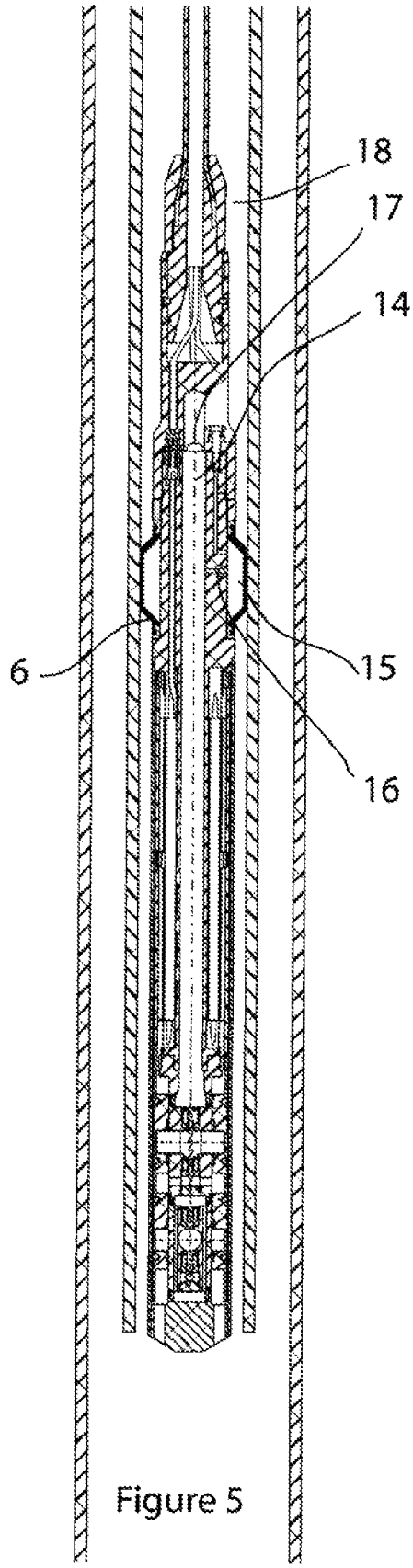
FIG. 5 is a side view of the through tubing ESP in situ in the lowermost part of a production tubing tailpipe with a discharge packer inflated.

Referring to FIG. 1, the ESP is lowered down the production tubing 2 until the required depth is reached, usually at the lower end of the production tubing, the assembly (or at least the lower end of the assembly) being submerged beneath the well fluid. Referring to FIG. 5, when the assembly is at the correct depth, the electric motor is turned on to drive the pump 8, which draws fluid through the pump inlet 9 along passage 18 and into the chamber 14. The chamber 14 is initially sealed by a burst disc 17 at its upper end from the assembly outlet 25. Referring to FIG. 5, as the pump 8 operates and pressure in the chamber 14 increases, fluid in the chamber 14 flows through a check valve 16 to inflate packer 15, securing the ESP in position and sealing it against the production tube 2.

Figure 6:
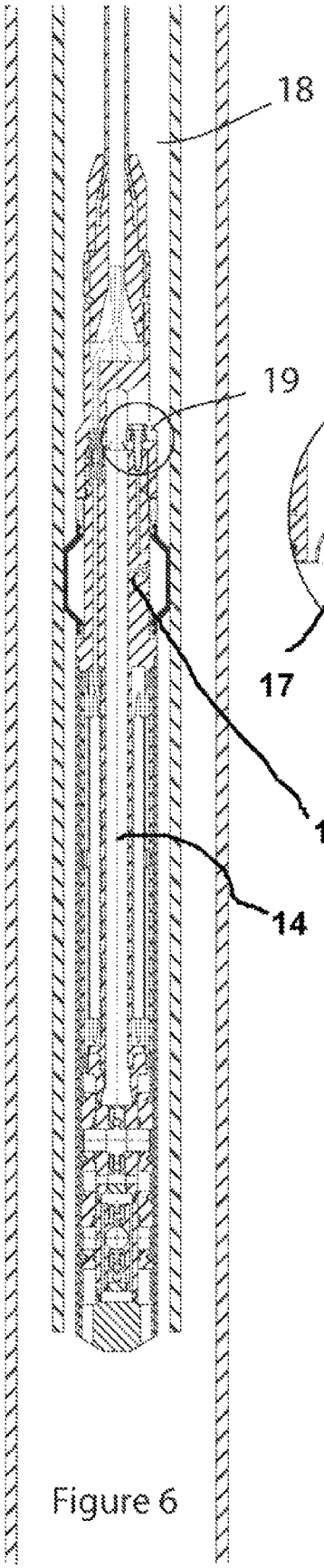
FIG. 6 is a side view of the through tubing ESP in situ in the lowermost part of a production tubing tailpipe pumping fluid.

Referring to FIG. 6, once the packer 15 has been fully inflated, the pressure in the chamber 14 continues to increase until the burst disc 17 ruptures, allowing fluid in the chamber 14 to exit the assembly through the assembly outlet 25. The packer 15 remains fully energized, securing the ESP in position and sealing it against the production tubing 2, since fluid in the packer 15 cannot pass back through the check valve 16. The pump 8 now displaces fluid from the well beneath the packer 15 through the pump inlet 9 into the chamber 14 and out of the assembly through the assembly outlet 25 into the annulus of the production tubing 2, and up to the surface.

Figure 6A:
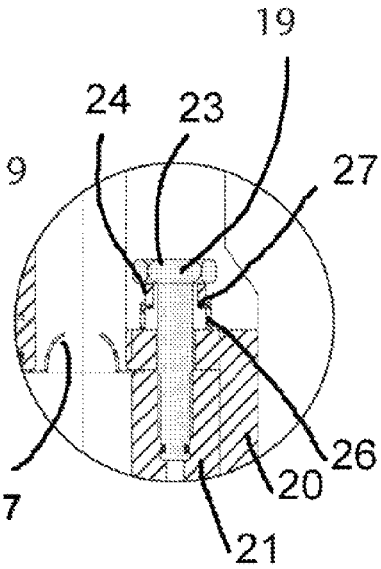
Figure 7:
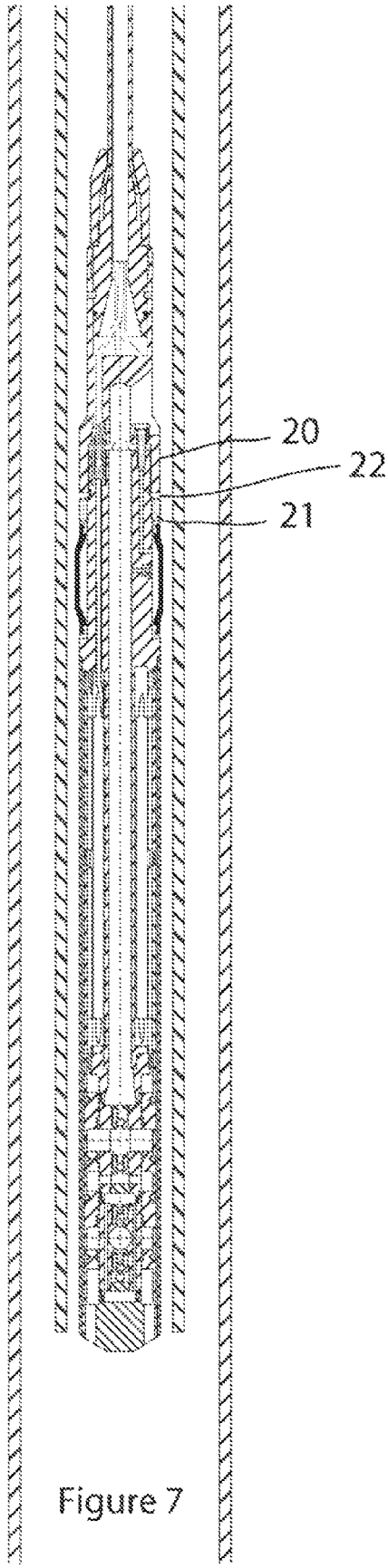
FIG. 7 is a side view of the through tubing ESP in situ in the lowermost part of a production tubing tailpipe deflating the packer

Referring to FIG. 6*a*, the upper housing section 20 and lower housing section 21 are attached by a bolt 19, the head 23 of the bolt 19 rests upon two spacers 24, 26 held in an extended relationship by shear pins 27. The shear pins are sufficient to support the weight of the lower housing section 21 when the ESP is being lowered down the production tube. When the packer 15 is fully inflated and engaged with the production tubing 2, the force needed to move the ESP is greater than the shear pins 27 can bear. Referring also to FIG. 7, if the well operator wishes to retrieve the ESP, sufficient tension is applied to the wireline so that the separation force between the upper and lower housing sections exceeds the force the shear pins 27 can withstand, so the upper spacer 24 slips inside the lower spacer 26 and the head 23 of the bolt 19 rests upon the lower spacer 26. This allows the upper housing section 20 and lower housing section 21 to separate a predetermined amount. Referring to FIG. 7, part of the lower housing initially covers a packer outlet port 22. However, once the upper and lower housing sections 20, 21 separate through the breaking of the shear pins, this packer outlet port 22 opens to lead to the production tube annulus. The fluid in the packer is at a greater pressure than the fluid surrounding the ESP, and the packer deflates, disengaging with the inner surface of the production tubing 2 and allowing the ESP to be pulled to the surface.

Figure 4:
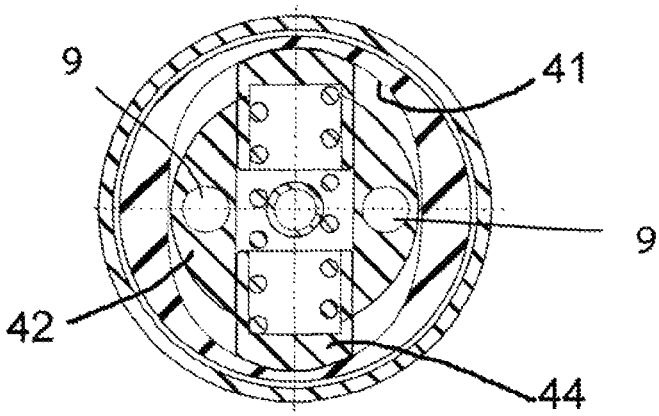
FIG. 4 is an end view cross section YY of FIG. 1

Ideally, the positive displacement pump 8 used is one more fully described in WO 2008/032126, but whose basic operation will be described here for completeness. As can be seen from FIG. 3, the inner bore 41 of the ESP housing is elliptical. The moving parts of the pump include a cylinder block 42 with a radial bore 43, having cylinders 44 which can move along the bore but which are biased outwardly by springs. When the motor 7 rotates the block 42, the cylinders 44 are moved radially inward and outward by the elliptical inner surface 41 of the housing. Using ball bearing valves (not shown) above and beneath the bore 43, fluid is drawn upward into the bore 43 as the cylinders 44 travel radially outward, and then ejected above the bore 43 where it is directed into axial bores 9 as the cylinders 44 return inward. The pump has several similar but differently aligned cylinders and bores stacked in series, FIG. 4 showing the cross section of another cylinder block and piston set further down the pump. Of course various types of known pump may be used in this invention.

Figure 8:
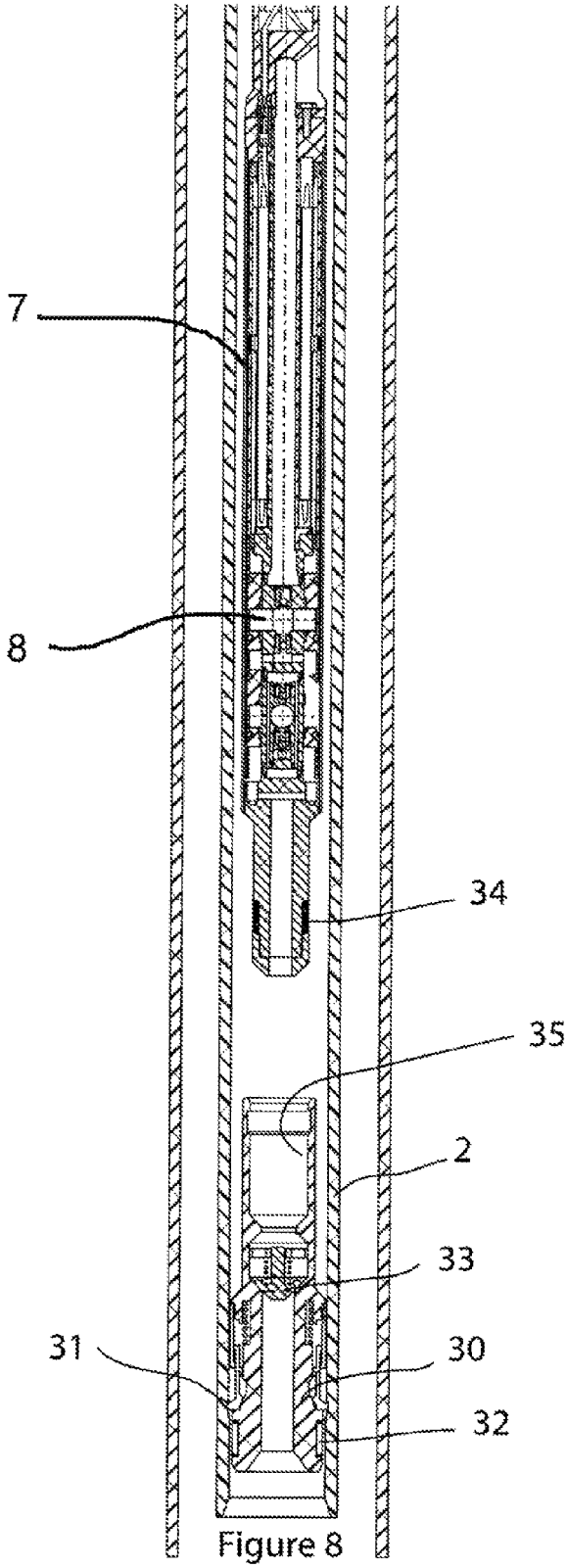
FIG. 8 is a side view of a electrical powered pump about to be docked into a standing valve
Figure 9:
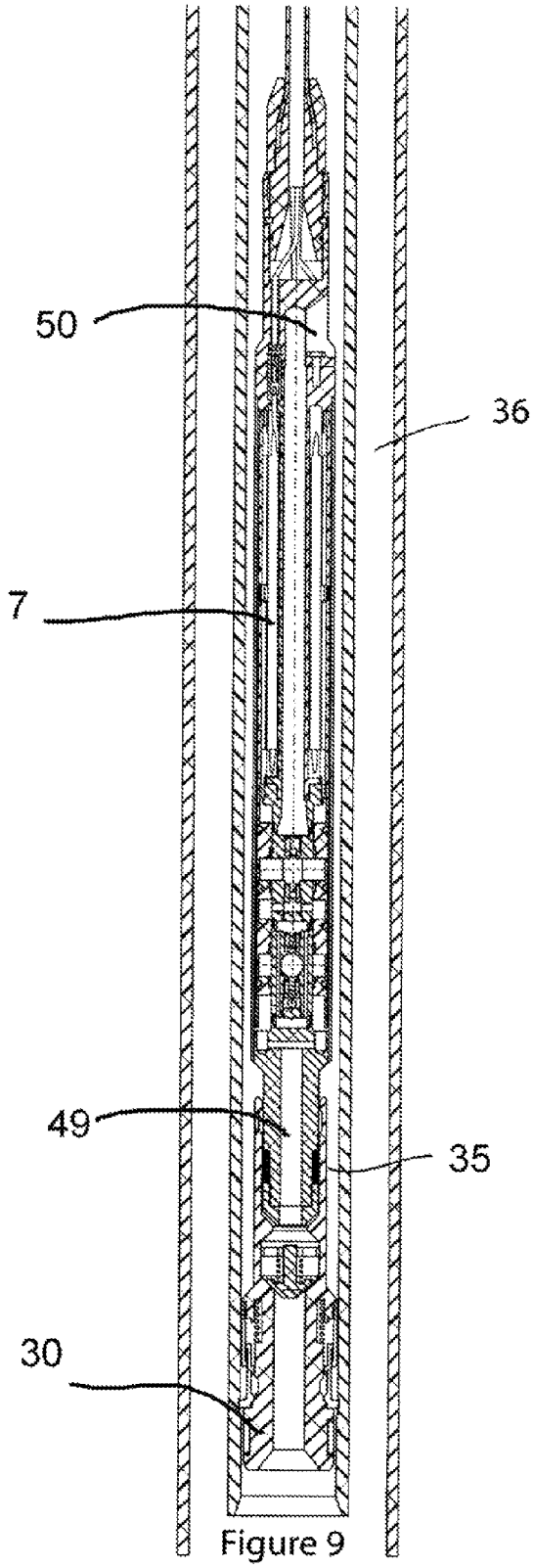
FIG. 9 is a similar side view as FIG. 8 with the ESP docked into the standing valve.

FIGS. 8 and 9 is an another means of separating the pump inlet from the pump discharge. In this example, a standing valve assembly 30 is latched into a nipple profile 31 in the tubing. The standing valve assembly has seals 32 and a check valve 33. This keeps any fluid pumped from the well inside the tubing, unlike the embodiment shown in FIGS. 1 to 7. The ESP is lowered into the well on wireline. At its lower end it has a stab in seal 34 which locates in bore 35 of the standing valve, so that when in the landed position shown in FIG. 9 the pump inlet 49 is separated from the pump discharge 50 by the standing valve assembly 30. The pump 8 again pumps the fluid up the center of the motor 7 and into the tubing annulus. If this was a gas well, excess fluid can be produced up the tubing while gas is produced up the casing annulus 36.

Although the embodiments described here are shown as deployed on a wireline, they could also be deployed on tubing (whether coiled tubing or a tubing string), so that a further path up the well bore is provided. With paths being provided by such deployment tubing and the annulus between the ESP and the production tube, pumped fluid could be drawn up one flowpath, while gas was allowed to flow up the other flow path, in a similar manner to the arrangement shown in FIGS. 8 and 9.

Alternative embodiments using the principles disclosed will suggest themselves to those skilled in the art upon studying the foregoing description and the drawings. It is intended that such alternatives are included within the scope of the invention, which is limited only by the claims.

What I claim is:

1. An electric submersible pump and motor assembly for downhole applications, the pump comprising:

an electric motor having a stationary nonrotating through bore, a pump driven by the electric motor, a deployment line upon which the electric motor and pump may be lowered down through a production tube, sealing means for sealing the assembly against the production tube, an inlet upstream of the sealing means through which well bore fluid may flow and that extends through the pump and the stationary nonrotating through bore of the motor, and an outlet open to the well bore downstream of the sealing means through which the well bore fluid may exit.

2. The assembly according to claim 1 wherein the outlet is located beneath a junction between the deployment line and the assembly.

3. The assembly according to claim 2 wherein the outlet is located above the bore of the motor.

4. The assembly according to claim 1 wherein the deployment line includes a power cable.

5. The assembly according to claim 1 wherein the deployment line includes continuous tubing.

6. The assembly according to claim 1 wherein the deployment line comprises a wireline.

7. The assembly according to claim 1 wherein the sealing means comprises an inflatable packer.

8. The assembly according to claim 7 wherein the fluid from the pump is constrained by a burst disc to enter the inflatable packer through a one-way valve, such that the burst disc breaks to allow the pumped well fluid access to the outlet upon the inflatable packer having been fully inflated.

9. The assembly according to claim 7 wherein the inflatable packer may be deflated to recover the electric submersible pump.

10. The assembly according to claim 9 wherein applying sufficient tension to the deployment line causes a shear element to break, opening a channel to inflatable packer causing the packer to deflate.

11. A system for pumping fluids in a borehole comprising a production line and the assembly according to claim 1.

12. The system according to claim 11, further comprising:

valve means at the bottom of the production line and separable from the electric submersible pump.

13. The system according to claim 12 wherein liquid is pumped up through the production line while gas is allowed to flow through an annular passage between the production line and the casing.

14. The system according to claim 12 wherein liquid is pumped up through an annular passage between the production line and the casing while gas is allowed to flow through the production line.

15. The system according to claim 11 wherein an inner diameter of the production line includes a mating profile at its lower end.

16. A method of deploying an electric submersible pump and motor assembly for downhole applications and having:

an electric motor having a stationary nonrotating through bore, a pump driven by the electric motor, a deployment line upon which the electric motor and pump may be lowered down through a production tube, sealing means for sealing the assembly against the production tube, an inlet upstream of the sealing means through which well bore fluid may flow and that extends through the pump and the stationary nonrotating through bore of the motor, and an outlet open to the well bore downstream of the sealing means through which the well bore fluid may exit, the method comprising the step of:

introducing the electric submersible pump is through a pressure control means at the well head without killing the well.

* * * * *